United States Patent [19]

Dornblaser et al.

[11] Patent Number: 5,003,753

[45] Date of Patent: Apr. 2, 1991

[54] INSIDE HEAD INSERTING APPARATUS AND METHOD

[75] Inventors: Norman E. Dornblaser, Elma, Wash.; David F. Hildermann, Portland, Oreg.

[73] Assignee: Haines & Emerson, Inc., Hoquiam, Wash.

[21] Appl. No.: 451,195

[22] Filed: Dec. 15, 1989

[51] Int. Cl.[5] ..... B65B 51/00; B65B 61/00

[52] U.S. Cl. ..... 53/415; 53/76; 53/135.1; 53/373.7

[58] Field of Search ..... 53/76, 129, 130, 137, 53/211, 290, 291, 292, 319, 330, 378, 379, 380, 410, 415, 478, 487, 488, 489; 156/69

[56] References Cited

U.S. PATENT DOCUMENTS

| | | | |
|---|---|---|---|
| 1,840,222 | 1/1932 | Brown | 53/211 X |
| 2,644,282 | 7/1953 | Irvine | 53/137 |
| 2,803,935 | 8/1957 | Gibson | 53/380 |
| 4,303,462 | 12/1981 | Karr | 53/137 X |
| 4,339,904 | 7/1982 | Koutonen et al. | 53/137 |
| 4,596,108 | 6/1986 | Piesen et al. | 53/211 X |
| 4,640,733 | 2/1987 | Bogren | 156/69 X |
| 4,724,654 | 2/1988 | Dahlin et al. | 53/357 X |
| 4,744,198 | 5/1988 | Hood et al. | 53/415 |
| 4,840,008 | 6/1989 | Hood et al. | 53/137 |

*Primary Examiner*—Robert L. Spruill
*Assistant Examiner*—Beth Bianca
*Attorney, Agent, or Firm*—Seed and Berry

[57] ABSTRACT

The invention provides an apparatus and method of inserting a lightweight, oversized, inside head to the end of a partially wrapped roll. An inside head is attached to multiple articulated arms extending from a spider assembly. The spider is moved toward the end of the roll until the articulated arms engage the end of the roll. The spider assembly opens the articulated arms radially outwardly until adjacent a wrapper tube extension. A heating clamp then welds the outer edge of the inside head to the wrapper tube extension.

22 Claims, 7 Drawing Sheets

INSIDE HEAD INSERTING APPARATUS AND METHOD

TECHNICAL FIELD

This invention relates to installing protective coverings on the end of an object to be wrapped. More particularly, this invention relates to equipment for and a method of inserting an inside head on the ends of a partially wrapped roll.

BACKGROUND OF THE INVENTION

Packages, such as paper rolls, must be covered or wrapped before they are shipped and handled. The wrapping serves to protect the package or roll from impact damage and to seal such things as moisture and foreign substances outside of the package.

Various roll wrapping systems and other packaging systems have been developed over the years to protect the rolls from impact damage and moisture during shipping and handling. A common problem in wrapping rolls has been encountered when attempting to seal the ends of the partially wrapped roll. A circular head is typically installed at each end of the roll.

Traditionally, a heavy, self-supporting head has been installed by holding the head with suction at the end of the roll while the wrapper tube extension is crimped over the head to secure the head in place. Modern roll wrapping techniques now use a lightweight, flexible, plastic-covered head for the inside head. This inside head cannot be handled or applied in a conventional manner.

Heads have been stapled or fastened by other mechanical means to a fiber core at the center of the roll. This requires the head to be made of a heavy, self-supporting material so that the portion of the head above the point of attachment will not fall down.

While it is generally preferable to use a lightweight material as a moisture barrier in wrapping, those in the art have recognized that lightweight heads are not self-supporting and thus cannot be secured to the end of the roll by crimping alone or by securing the lightweight head to the center fiber core of the roll.

SUMMARY OF THE INVENTION

The invention comprises a novel way of inserting a lightweight, oversized inside head on the ends of a partially wrapped roll. Articulated arms extending from a spider assembly grasp and support the lightweight inside head to be inserted at the end of a roll. A horizontal drive assembly urges a carriage on which the spider assembly is mounted toward the roll until the inside head engages the end of the roll.

The articulated arms then expand radially outwardly toward the outside diameter of the roll. As the articulated arms are opened radially, the arms are also moved toward the end of the roll. Once the arms are fully extended in their radial direction, fastening means join the head to the wrap extension.

In one embodiment, the arms are provided with suction devices to hold the head. When the head is pressed against the end of the roll, the suction is released and the suction devices slide along the head as the arms are move radially.

In an embodiment, clamps at the ends of the arms clamp and weld the head and wrapper extension together. Other forms of fastening, such as glue or interlocking tabs (similar to dog-earring), may be employed.

The "dog-earring" involves punching a U-shaped slot through both the inside head and the wrapper tube extension to form a U-shaped flap and folding the U-shaped flap to create a mechanical bond between the inside head and the wrapper tube extension.

BRIEF DESCRIPTION OF THE DRAWINGS

FIG. 8 is a block diagram showing multiple head inserting stations.

DETAILED DESCRIPTION OF THE INVENTION

The present invention relates to inserting an oversized, lightweight head to an end of a partially wrapped roll. Preferably, the wrapper on the outside of the roll is made of plastic, such as a polyvinyl material amenable to welding to another similar material. Polyvinyl is a highly suitable material for use as a moisture barrier. Therefore, one preferred inside head is made of a polyvinyl for welding to a wrapper tube extension made of plastic or paper coated with plastic.

Figure 1:
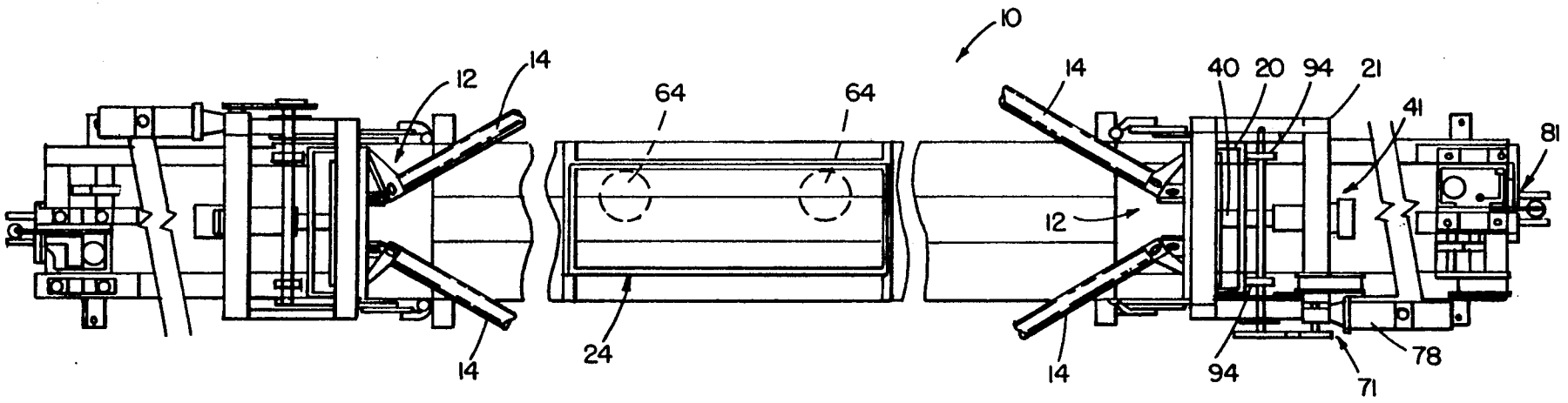
FIG. 1 is a top assembly view of the inside head inserting apparatus.
Figure 2:
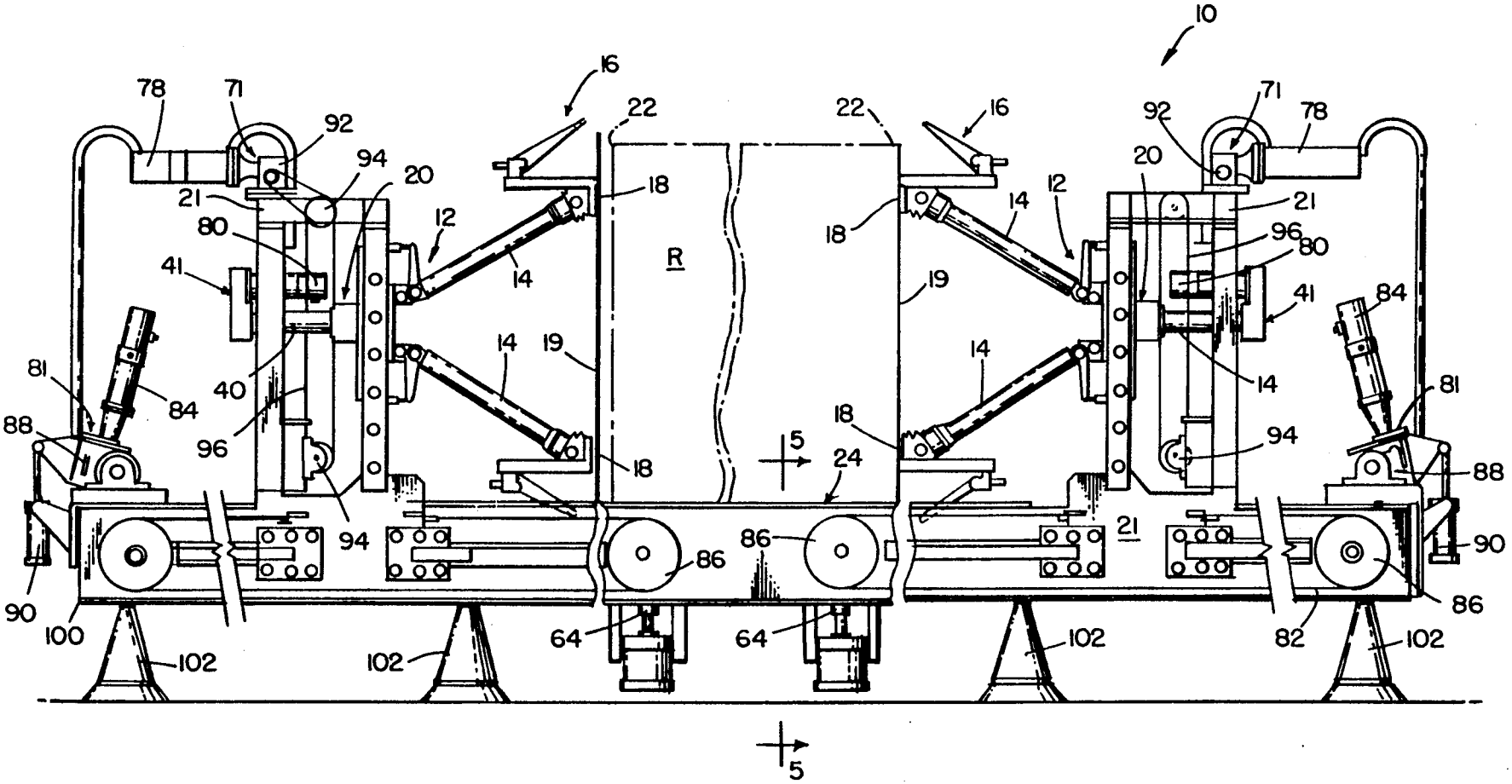
FIG. 2 is a side elevation view of the inside head inserting apparatus.

As best shown in FIGS. 1 and 2, an inside head inserting apparatus 10 includes a spider assembly 12 and articulated arms 14 pivotally connected to the spider assembly. Suction cups 18 are coupled to the ends of the articulated arms for holding an oversized inside head to be inserted at an end of a roll. The head will generally not be self-supporting when held in a vertical plane. Heating clamps 16 are also attached to the ends of the articulated arms for welding the oversized, inside head to an outside wrapper tube extension 22. A holding pocket 24 holds the roll during insertion of the inside head. Once the insertion process has been completed, ejection cylinders 64 eject the roll onto a conveyor, which takes the roll to a subsequent station. The overall inside head inserting apparatus 10 is mounted on a main frame 100 supported by pedestals 102.

The vertical positioning of the articulated arms 14 and the spider assembly 12 is accomplished by a vertical drive assembly 71 which moves a carriage 20 up and down on a frame 21. The vertical drive assembly aligns the center axis of the spider assembly 12 with the center axis of the roll. The articulated arms and the spider assembly are positioned horizontally toward the end of the roll by a horizontal drive assembly 81 which moves the frame 21 toward and away from the end of the roll. A linear actuator drive assembly 41 coupled to the spider assembly causes the articulated arms to open radially outwardly until the arms are adjacent the wrapper tube extension 22 of the roll as determined by a computer measurement previously obtained of the roll diameter.

Figure 3:
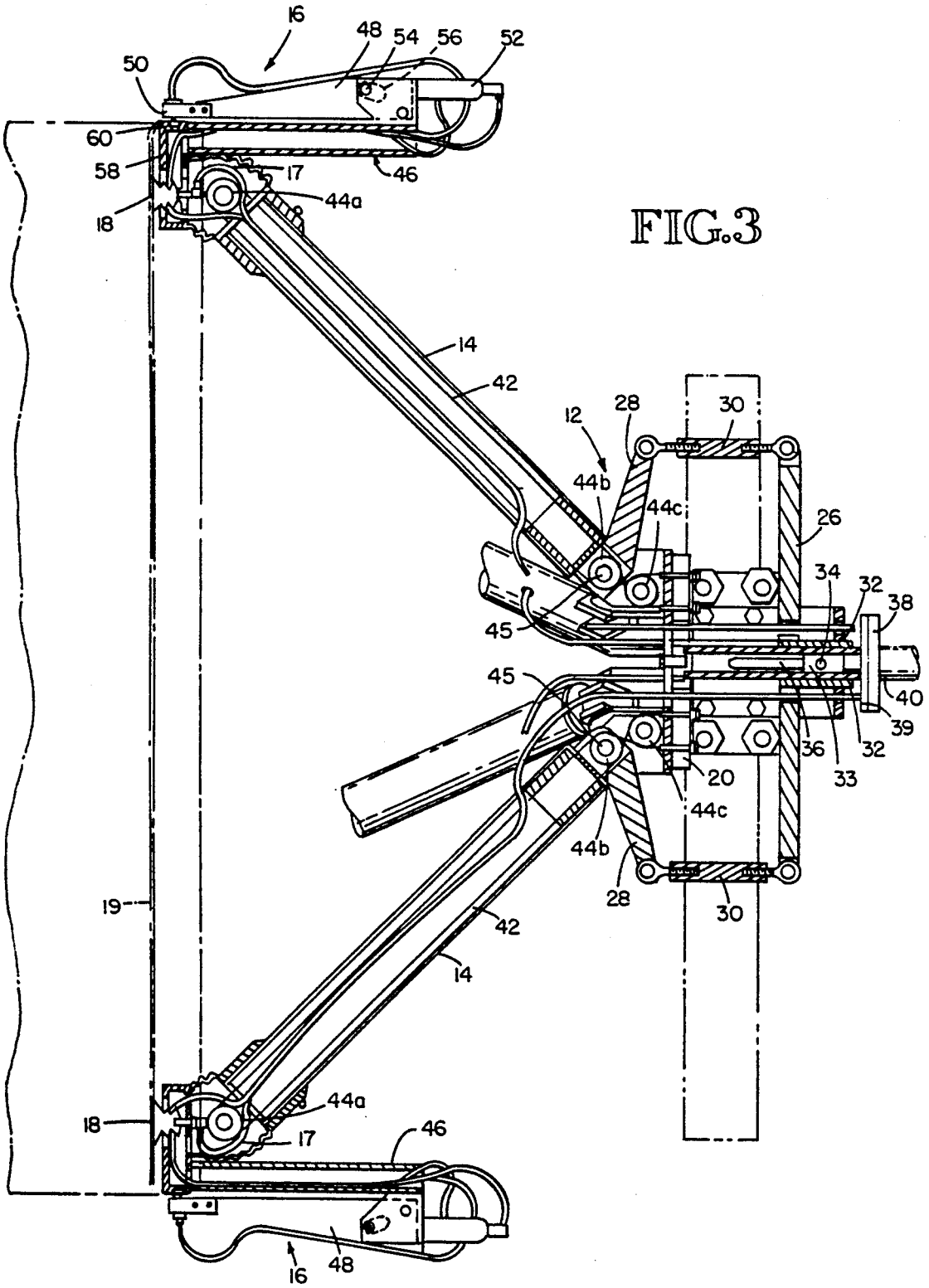
FIG. 3, is a sectional view of the spider assembly including the articulated arms, taken along the line 3—3 of FIG. 4.

Referring now to FIG. 3, the spider assembly 12 comprises a back plate 26 coupled to flanges 28 of articulated arms 14 by link members 30. The back plate of the spider is rigidly connected to a short tube 32, which is coupled, in turn, to a rod eye 33 by a pin 34. The spider assembly further includes a spider hub 38 having a horizontal slot 36 in which the pin connecting the rod eye to the short tube rides when the rod eye is moved left and right (as shown in FIG. 3) by a linear actuator 40. Engagement of the short tube pin with the spider hub slot also serves to prevent the spider hub from rotating. The spider assembly is supported on a tube mounting plate 39.

The linear actuator 40 provides the horizontal moving force for the spider assembly. As shown in FIG. 2, linear actuator drive assembly 41 includes a servomotor 80 which drives the linear actuator and causes the rod eye 33 to move toward and away from the roll. As the rod eye moves away from the roll (to the right in FIG. 3), the short tube 32 and the plate also move away from the roll and cause the articulated arms 14 to open radially.

Referring again to FIG. 3, articulated arms 14 are connected to the spider via flanges 28. As the back plate 26 is advanced away from the end of the roll, the arms 14 rotate about pivotal connections 45 expand radially outwardly from the center axis of the spider assembly 12. Parallelogram cables 42 are mounted around pulleys 44*a*, 44*b*, 44*c* and are secured to the carriage 20 to ensure that the suction cups 18 remain constantly in a vertical plane and in the same plane as the inside head 19 when the articulated arms are radially opened and closed. The articulated arms can be adjusted for inserting inside heads of various diameters.

In one embodiment, heating clamps 16 are attached to the ends of the articulated arms 14 opposite the spider assembly 12. Each heating clamp comprises a clamp arm 48 pivotally connected to an anvil 46. A cartridge heater 50 is attached to an end of the clamp arm opposite the pivotal connection which supplies heat for welding the inside head 18 to the wrapper tube extension 22.

Preferably, the length of the wrapper tube extension should be between 2" and 6" in length for proper welding. It is not critical to clamp any specific area of the combined wrapper tube extension and inside head, only that the clamp is applied within this range. Once the outer edge of the inside head and the wrapper tube extension are positioned for welding, the clamp arm is pivoted toward the anvil by actuating a pneumatic cylinder 52 which forces a rod 54 of the cylinder to slide along cam slot 56 and causes the clamp arm to engage the anvil. The pneumatic cylinder locks the arm in place long enough for welding the inside head to the wrapper tube extension.

A spot face 60 is located at the top of a vertical portion 58 of the anvil 46, and is filled with a heat-resistant, resilient compound, such as silicon. The spot face corresponds to the contact point of heater 50 to cushion the clamping force of the clamp arm 48 and allow the heating clamp 16 to exert a strong clamping force without damaging the inside head 19 or the wrapper tube extension 22. In addition, the spot face serves to isolate the heat provided by the cartridge heater and prevent the heat from being conducted away from the area to be welded through the metal housing. The spot face thus enhances the welding efficiency of the heating clamp and protects the members to be welded.

Suction cups 18 or other gripping members are coupled to the vertical portion 58 of the anvil 46. The suction cups are positioned equidistantly around the outer edges of an inside head for holding the head during the initial steps of the inserting process. Once the inside head has been positioned on the suction cups of the articulated arms, the air inside of the suction cups is evacuated by air hoses 17 creating a vacuum inside the suction cups. To release the vacuum, air is blown into the suction cups.

Figure 5:
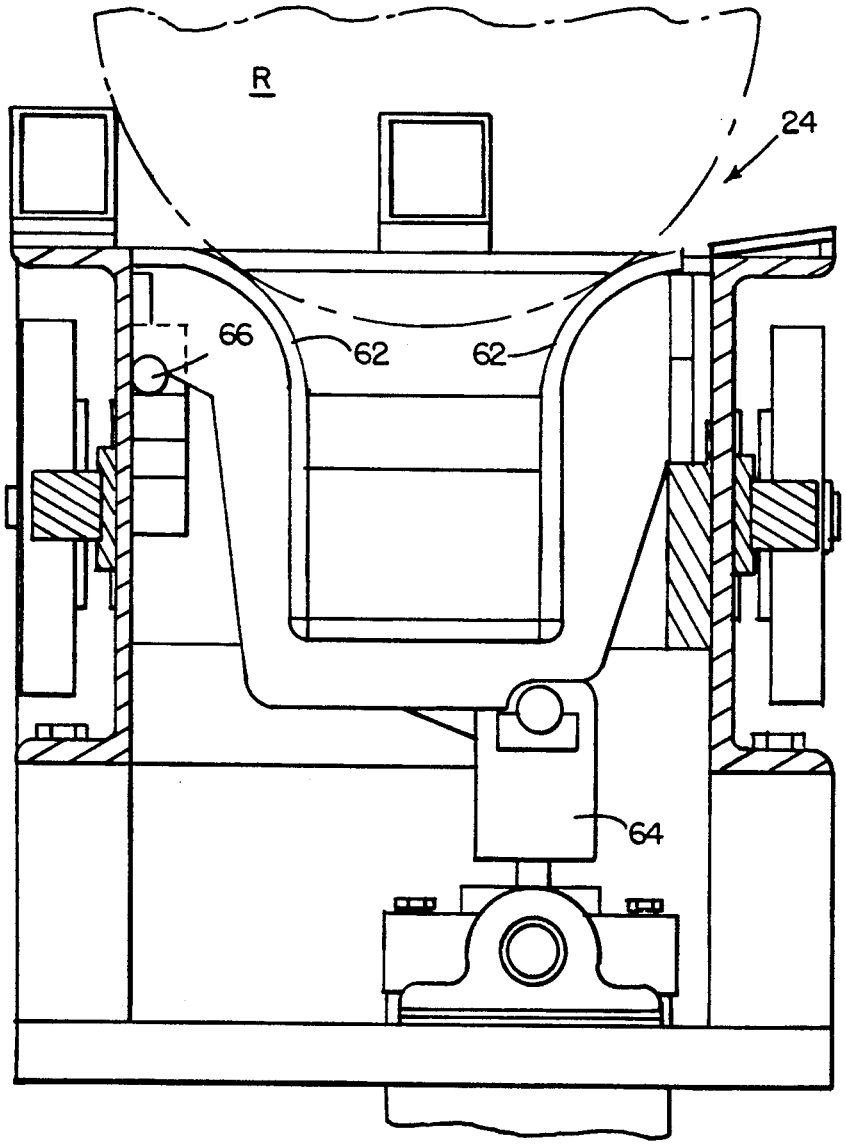
FIG. 5 is a sectional view taken along the line 5—5 of FIG. 2.

As best shown in FIG. 5, a holding pocket 24 supports the roll during the insertion of an inside head 19. The roll is cushioned in the holding pocket at the head insertion station by bottom pivot bumpers 62. Once an inside head has been installed on each side of the roll, ejection cylinders 64 push holding pocket 24 upwardly about hinge 66 to expel the roll from the holding pocket onto a conveyor belt, which moves the roll downstream to a subsequent station. The tasks performed at the subsequent station might involve crimping of the wrapper tube extension 22 over the inside head, inserting a second corrugated inside head for cushioning the end of the roll, or inserting a heavy, self-supporting outside head which is secured to the end of the roll by crimping the wrapper tube extension over the outside head.

Figure 4:
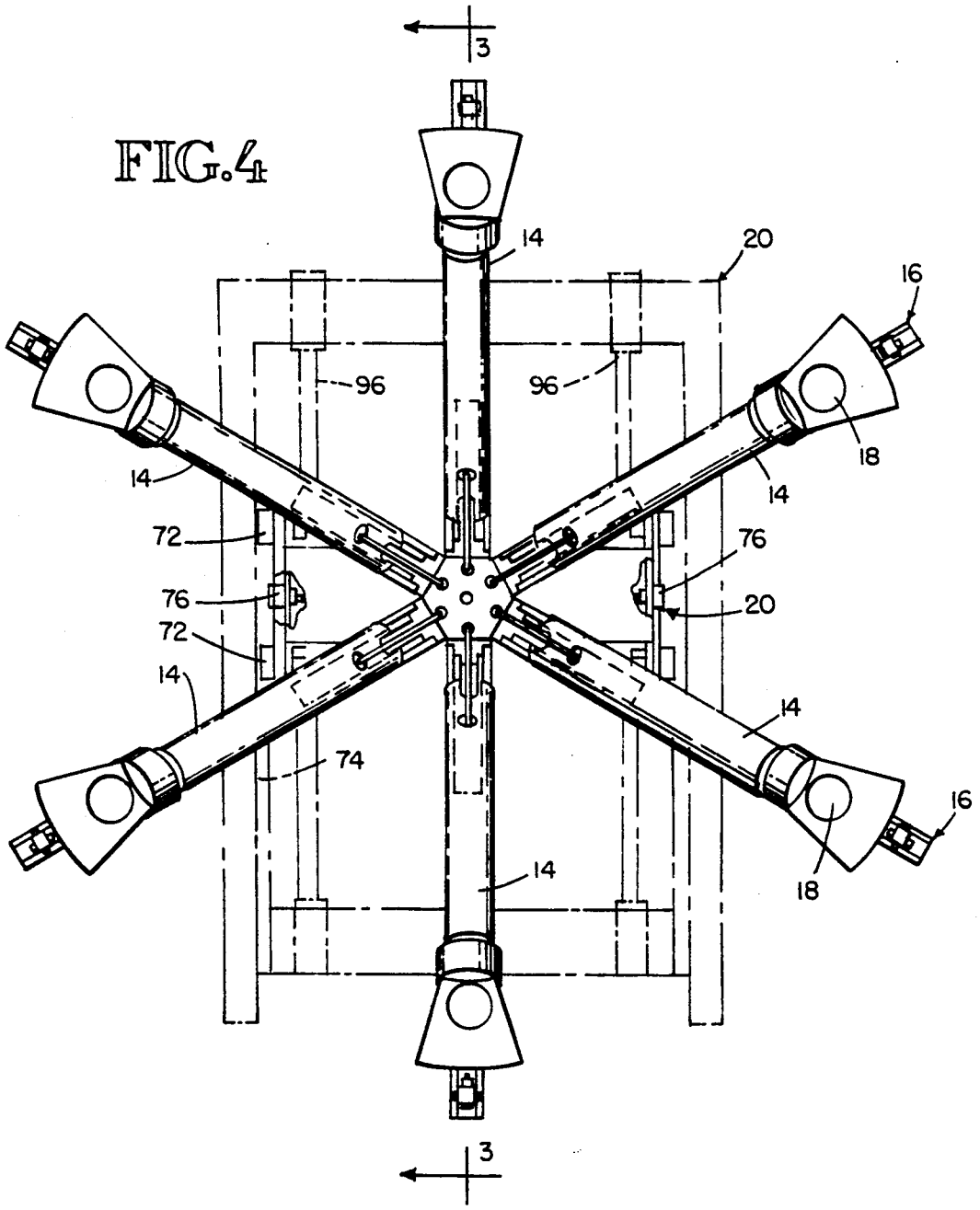
FIG. 4 is a fragmentary view looking into the spider assembly and articulated arms.

The vertical movement of the spider assembly 12 is accomplished by vertical drive assembly 71. As best shown in FIGS. 2 and 4, the vertical drive assembly comprises a servomotor 78 coupled to a gear box 92 which rotates drive pulleys 94. A pair of toothed belts 96 are mounted on the drive pulleys and attached to the carriage 20 to move the carriage vertically. The toothed belts are Preferably ¼" thick and 1½" to 2" wide. The carriage is moved along rail 74 of the upright frame 21 by cam rollers 72 attached to the carriage. A low friction pad 76 minimizes the side-to-side movement of the rollers relative to the rail and prevents the carriage from scraping as it moves up and down.

The diameter of the roll is known before the insertion process begins, and thus it is programmed into the control box of the servomotor 78 to ensure that the center axis of the spider assembly 12 is aligned with the center axis of the roll. This vertical adjustment capability allows the head inserting apparatus to be used with a variety of roll diameters.

With respect to the horizontal movement of the upright frame 21 relative to the main frame 100, FIG. 2 shows a toothed belt 82, with preferable characteristics similar to those of toothed belts 96 mentioned above, attached to the upright frame and mounted around pulleys 86. A servomotor 84 rotates pulleys 86 through a gear box 88 which causes toothed belts 82 to rotate and, in turn, move the upright frame, including the spider assembly 12 and the articulated arms 14, toward the end of the roll. The servomotor is preprogrammed to slow down the speed of horizontal movement toward the roll when the inside head approaches the end of the roll. The servomotor is turned off after the articulated arms have physically sensed the end of the roll and then restarted as will be described.

Figure 6A:
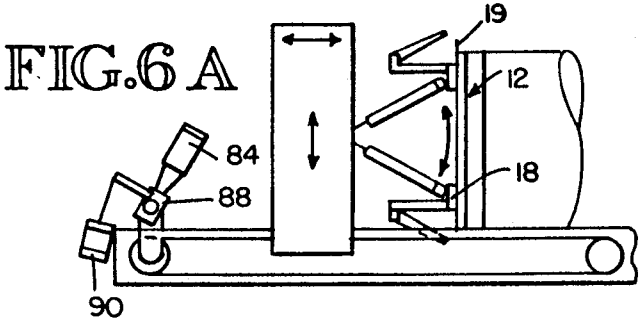
FIGS. 6A, 6B, 6C, 6D, and 6E are schematic views of the method of inserting an inside head to the end of a partially wrapped roll.

The full sequence of inserting an inside head 19 to the end of a roll is shown in FIGS. 6A, 6B, 6C, 6D, and 6E. To begin, the vertical position of the spider assembly 12 is adjusted to coincide with the central axis of the roll. After an oversized inside head has been secured on the inserting apparatus by the suction cups 18, servomotor 84 is actuated which causes the upright frame to move horizontally toward the end of the roll, as shown in FIG. 6A.

Figure 6B:
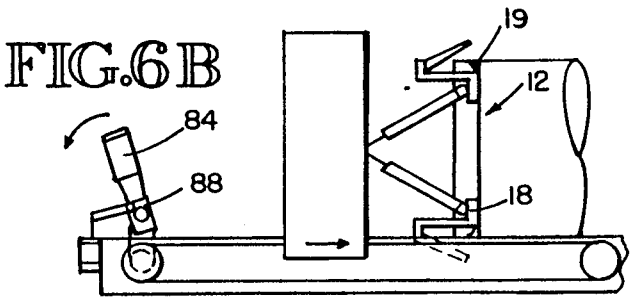
Figure 7:
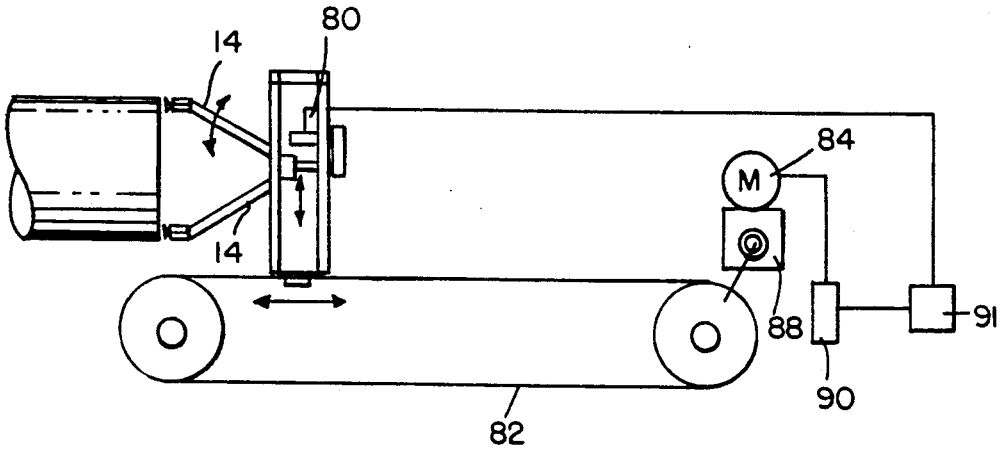
FIG. 7 is an operational schematic of the inside head inserting apparatus.

Once the ends of the articulated arms 14 approach the end of the roll, the speed of the servomotor 84 slows down. At this slower speed, the articulated arms holding the inside head push the head against the end of the roll which causes the servomotor 84 to rotate about the gear box 88 which compresses the air in pneumatic air cylinder 90 coupled to a pressure switch 91 (FIG. 7) and turns off the servomotor 84, as shown in FIG. 6B. At this point, air is blown into the suction cups 18 to release the vacuum holding force and the head is held against the roll end by friction.

Figure 6C:
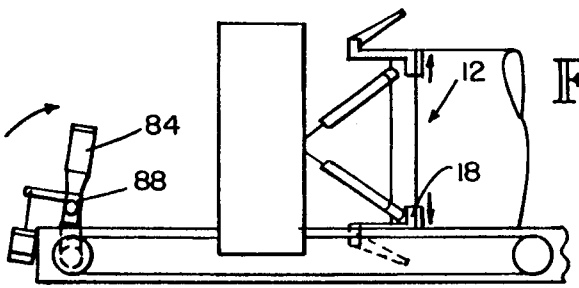

The linear actuator 40 attached to the spider assembly 12 is then rotated by servomotor 80, which causes the articulated arms 14 to open radially while the suction cups 18 frictionally slide along the inside head surface until the ends of the arms are adjacent the wrapper tube extension 22. When the arms open, the ends of the arm attempt to pivot slightly away from the end of the roll. This reduces the torque on the gear box 88, allowing the cylinder 90 to extend, rotating gear box 88 and servomotor 84 around their mounting shaft. This rotation causes the horizontal carriage to move inward, maintaining the pressure of the arms against the head to hold the head against the end of the roll, as shown in FIG. 6C.

Once the overhang of inside head 19 is against the inside of the wrapper extension, the clamp arms 48 of heating clamps 16 are pivoted into engagement with the anvils 46, which clamps the edge of the inside head and the wrapper tube extension together for welding. The clamping arms remain locked until the inside head and the wrapper tube extension have been welded together.

Figure 6E:
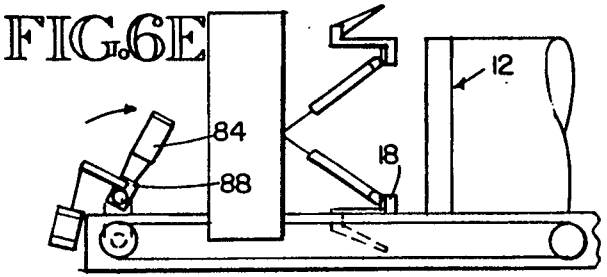
Figure 6D:
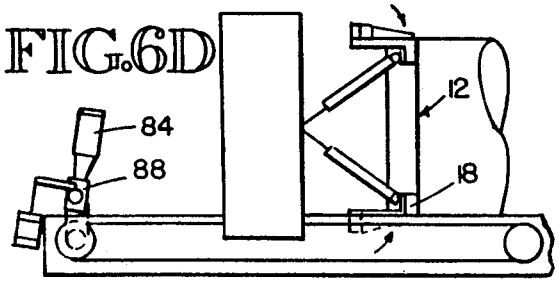

Once the welding has been completed, the clamps are opened, the servomotor 84 is reversed and the upright frame 21 is moved away from the end of the roll, as shown in FIG. 6E. The roll is then ejected from the holding pocket 24 onto a conveyor to be taken to a subsequent station.

While the preferred methods and embodiments of the present invention have been illustrated and described, it is to be understood that variations will be apparent to one of ordinary skill in the art without departing from the principles described herein. Accordingly, the invention is not to be limited to the specific embodiment illustrated in the drawings.

We claim:

1. A method of securing an oversized, lightweight, flexible head to the inside of a wrapper tube extension of a partially wrapped roll at a first station, the steps comprising:
   - holding the head at multiple spaced locations about an axis of the head;
   - axially moving the held head into engagement with an end of a partially wrapped roll inside a wrapper tube extension;
   - radially moving the multiple holding locations of the head outwardly until adjacent the wrapper tube extension; and
   - securing the head to the wrapper tube extension.

2. The method of claim 1 wherein the head is held at equidistantly spaced locations.

3. The method of claim 1, further comprising the step of moving the head axially toward the roll end while radially moving the spaced holding locations outwardly.

4. The method of claim 3, further comprising the step of sensing the end of the roll with the spaced holding locations before radially moving the spaced locations outwardly.

5. The method of claim 1, further comprising the step of vertically moving the head into alignment with a center axis of the roll.

6. The method of claim 1, further comprising the step of moving the roll to a second station, inserting a second, outside head on top of the inside head, and crimping the wrapper tube extension of the partially wrapped roll over an outer edge of the outside head.

7. The method of claim 1, further comprising the step of moving the roll to a second station and inserting a second, corrugated inside head for cushioning the end of the roll during shipping and handling.

8. The method of claim 7, further comprising the step of moving the roll to a third station, inserting a third, outside head on top of the second, corrugated inside head, and crimping the wrapper extension tube over an outer edge of the outside head.

9. The method of claim 1 wherein the step of securing the head to the wrapper tube extension comprises welding the inside head to the wrapper tube extension.

10. The method of claim 1 wherein the step of securing the head to the wrapper tube extension comprises punching a U-shaped slot through both the inside head and the wrapper tube extension to form a U-shaped flap and folding the U-shaped flap to create a mechanical bond between the inside head and the wrapper tube extension.

11. The method of claim 1, further comprising the steps of:
   - sensing the end of the roll at equidistantly spaced holding locations;
   - moving the head axially toward the roll while radially moving the holding locations outwardly; and
   - wherein the securing step comprises clamping the head and the wrapper tube extension together and applying heat to weld the head to the wrapper tube extension.

12. The method of claim 1, further comprising the steps of:
   - vertically moving the head into alignment with the center axis of the roll;
   - sensing the end of the roll at the spaced holding locations, the head being held at equidistantly spaced locations by suction;
   - releasing the suction before radially moving the spaced holding locations outwardly, the head being held in place by friction while radially moving the holding locations outwardly;
   - moving the head axially toward the roll while radially moving the holding locations outwardly; and
   - wherein the securing step comprises clamping the head and the wrapper tube extension together and applying heat to weld the head to the wrapper tube extension.

13. A head inserting apparatus, comprising:
   - support means for supporting a head at multiple locations;
   - holding means for holding a partially wrapped roll having a wrapper tube extension;
   - means for axially moving the supported head into engagement with an end of the partially wrapped roll;

means for radially moving the multiple support locations outwardly until adjacent the wrapper tube extension; and securing means for securing the head to the wrapper tube extension.

14. A head inserting apparatus as recited in claim 13, further comprising a means for sensing the end of the roll.

15. A head inserting apparatus as recited in claim 13, further comprising means for moving the head axially toward the roll end while radially moving the spaced holding locations outwardly.

16. A head inserting apparatus as recited in claim 13 wherein the support means includes a plurality of articulated arms having gripping members for holding the head at multiple spaced locations.

17. A head inserting apparatus as recited in claim 16 wherein the gripping members comprise suction cups.

18. A head inserting apparatus as recited in claim 16, said means for radially moving the multiple support locations outwardly including a spider assembly connected to a frame, means for connecting the activated arms to the spider assembly such that horizontal movement of the spider assembly relative to the frame causes the articulated arms to open and close radially while the suction cups are maintained in a vertical position and parallel to the plane of the head.

19. A head inserting apparatus as recited in claim 13 wherein the holding means comprises a holding pocket which cushions the roll being received from a previous station and ejects the roll after the head has been inserted so that the roll can be moved to a subsequent station.

20. A head inserting apparatus as recited in claim 13 wherein the means for radially moving the multiple support locations comprises a horizontal drive mechanism coupled to a spider assembly whereby actuation of the horizontal drive mechanism causes the multiple support locations to extend radially outwardly on a surface of the head until adjacent the wrapper tube extension.

21. A head inserting apparatus, comprising:

support means for supporting a head at multiple locations;

holding means for holding a partially wrapped roll having a wrapper tube extension;

means for axially moving the supported head into engagement with an end of the partially wrapped roll;

means for radially moving the multiple support locations outwardly until adjacent the wrapper tube extension; and securing means for securing the head to the wrapper tube extension wherein the securing means comprises a heating clamp having a clamp arm pivotally connected to an anvil, and a heater connected to an end of the clamp arm opposite the pivotal connection for welding the head to the wrapper tube extension.

22. A head inserting apparatus, comprising:

support means for supporting a head at multiple locations;

holding means for holding a partially wrapped roll having a wrapper tube extension;

means for axially moving the supported head into engagement with an end of the partially wrapped roll;

means for radially moving the multiple support locations outwardly until adjacent the wrapper tube extension;

securing means for securing the head to the wrapper tube extension; and wherein the anvil includes a counterbore filled with a heat-resistant, resilient material to isolate and concentrate the heat of the heater for welding the head to the wrapper tube extension, the resilient material cushioning the clamping force of the clamp arm to allow strong clamping action, yet protect the head and the wrapper tube extension from damage due to clamping.

* * * * *